United States Patent [19]

Siegel

[11] Patent Number: 4,561,097

[45] Date of Patent: Dec. 24, 1985

[54] PUZZLE FORMED OF GEOMETRIC PIECES HAVING AN EVEN NUMBER OF EQUILATERAL SIDES

[76] Inventor: Florence Siegel, 187-10 Aberdeen Rd., Jamaica Estates, N.Y. 11432

[21] Appl. No.: 658,571

[22] Filed: Oct. 9, 1984

[51] Int. Cl.[4] ..... A63F 9/10

[52] U.S. Cl. ..... 273/157 R; 434/96

[58] Field of Search ..... 273/157 R; 434/96, 211

[56] References Cited

U.S. PATENT DOCUMENTS

| | | | |
|---|---|---|---|
| 1,087,207 | 2/1914 | Austin | 434/96 |
| 2,053,001 | 9/1936 | Haliburton | 273/157 R |
| 3,637,217 | 1/1972 | Kent | 273/157 R |
| 4,223,890 | 9/1980 | Schoen | 273/157 R |

FOREIGN PATENT DOCUMENTS

| | | | |
|---|---|---|---|
| 240612 | 10/1925 | United Kingdom | 273/157 R |

OTHER PUBLICATIONS

Scientific American, Jan. 1977, cover, pp. 110–112, and 115–121.

*Primary Examiner*—Anton O. Oechsle

*Attorney, Agent, or Firm*—Shenier & O'Connor

[57] ABSTRACT

A puzzle in which each of a number of regular octagons is divided to form an irregular octagon and a number of smaller pieces. Each irregular octagon has four pairs of equilateral parallel sides. Each of the smaller pieces has two pairs or three pairs of equilateral parallel sides. The sides of all parts formed are equal in length. A number of the pieces are capable of being assembled in juxtaposition to form a large regular octagon, which assembly can be performed in a large number of different ways.

13 Claims, 28 Drawing Figures

PUZZLE FORMED OF GEOMETRIC PIECES HAVING AN EVEN NUMBER OF EQUILATERAL SIDES

BACKGROUND OF THE INVENTION

Many geometric puzzles, adapted to educate children and amuse adults, have been proposed. I have discovered that it is possible to dissect a regular octagon to form at least one irregular octagon and one or more smaller pieces. The dissection is such that each of the smaller pieces takes the form of a rhombus, a square, a regular hexagon, or an irregular hexagon. The parts from eight dissected regular octagons may be assembled to form a large tessellated regular octagon. The puzzle provides an intimate knowledge of geometry and is an amusing and instructive one. By providing the pieces with various colors, beautiful octagonal designs may be made to appear when the puzzle is assembled.

Field of the Invention

My invention relates to an educational puzzle and, more particularly, to a puzzle having a plurality of geometric shapes adapted, when assembled, to form an octagon.

DESCRIPTION OF THE PRIOR ART

Educational puzzles of the prior art have been known for many years.

Mason U.S. Pat. No. 232,140 shows squares, triangles, rhombuses, and hexagons dissected into various pieces adapted, when assembled, to form the geometric shape from which the individual pieces were derived. None of the pieces has the form of an irregular octagon.

Bishop U.S. Pat. No. 1,657,736 discloses a puzzle having a plurality of pieces adapted to be assembled into either a star or a cross. None of the pieces has the form of an irregular octagon.

Haliburton U.S. Pat. No. 2,053,001 discloses two sets of shapes adapted to be assembled into an octagon or into an irregular geometric figure. Neither of the two shapes has the form of an irregular octagon.

Lee U.S. Pat. No. 3,178,186 discloses a puzzle, the pieces of which are adapted to be assembled into the form of a square, a hexagon, or a triangle. None of the pieces has the form of an irregular octagon.

Kent U.S. Pat. No. 3,637,217 shows a puzzle formed of triangles, trapezoids, rhombuses, rhomboids, and regular hexagons adapted to be assembled to form a regular hexagon in a number of different ways. None of the pieces has the form of an irregular octagon.

Spiecker U.S. Pat. Des. 265,919 shows a mosaic of a square formed of two irregular hexagons, four triangles, two squares, one rectangle, one rhomboid, one irregular trapezoid, and one irregular pentagon. There is no disclosure of an irregular octagon.

SUMMARY OF THE INVENTION

In general, my invention comprises the dissecting of a number of regular octagons to form one irregular octagon and one, two, three, four, or five smaller pieces. The irregular octagon is characterized by having four pairs of equilateral parallel sides. Each of the smaller pieces of the octagon takes the form of a rhombus, a square, a regular hexagon, or an irregular hexagon. Both the regular and irregular hexagons are formed with three pairs of equilateral parallel sides. The irregular hexagon differs from the regular hexagon in that it possesses two adjacent sides forming an angle greater than 180 degrees. The puzzle is formed of eight sets of the pieces of twenty-one dissected regular octagons, each of which regular octagons is dissected in a different manner. Certain of the pieces may be assembled to form a tessellated large octagon, and certain of the other pieces may be assembled to form smaller tessellated large octagons in a large number of various manners.

OBJECTS OF THE INVENTION

One object of my invention is to provide an instructional and educational puzzle, formed of geometrically shaped pieces adapted to be assembled in various sets to produce a number of tessellated octagons.

Another object of my invention is to provide a series of geometrically shaped pieces, including an irregular octagon, adapted to be assembled in various ways to produce a regular octagon.

Still another object of my invention is to provide a plurality of pieces, obtained by dissecting a number of regular octagons in different manners, in which certain pieces may be colored so that, when assembled, the pieces will form a regular octagon presenting an attractive and original tessellated design.

A further object of my invention is to provide a puzzle, formed of geometrically shaped pieces, which may be assembled in a large number of different ways, each assembly resulting in a tessellated regular octagon.

Other and further objects of my invention will appear from the following description.

BRIEF DESCRIPTION OF THE DRAWINGS

In the accompanying drawings, which form part of the instant specification and which are to be read in conjunction therewith.

DESCRIPTION OF THE PREFERRED EMBODIMENT

Figure 1:
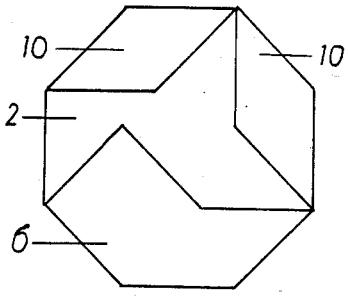
FIG. 1 shows a regular octagon dissected to form one irregular octagon, two rhombuses, and one irregular hexagon.
Figure 2:
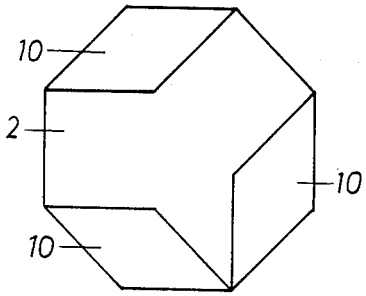
FIG. 2 shows a regular octagon dissected to form one irregular octagon and three rhombuses.

More particularly, referring now to the drawings, I have applied the reference numeral 2 to each irregular octagon. It will be observed, by referring to FIGS. 1–21, that each of the irregular octagons has a different form. However, each irregular octagon is formed with four pairs of equilateral parallel sides.

I have indicated each regular hexagon by the reference numeral 4. It will be noted, by referring to FIGS. 4 and 12, that each of the regular hexagons is formed with three pairs of equilateral parallel sides.

I have indicated each irregular hexagon by the reference numeral 6. It will be noted, by referring to FIGS. 1, 3, 5, 6, 9, and 11, that each of the irregular hexagons is formed with three pairs of equilateral parallel sides.

Figure 8:
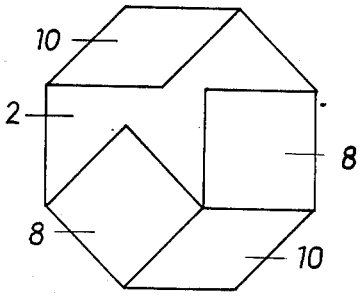
FIG. 8 shows a regular octagon dissected to form one irregular octagon, two rhombuses, and two squares.
Figure 9:
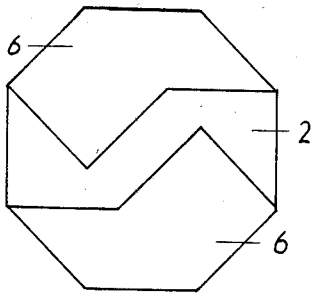
FIG. 9 shows a regular octagon dissected to form one irregular octagon and two irregular hexagons.
Figure 19:
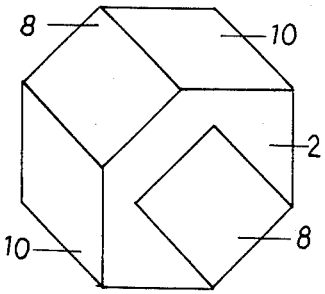
FIG. 19 shows a regular octagon dissected to form one irregular octagon, two rhombuses, and two squares.
Figure 20:
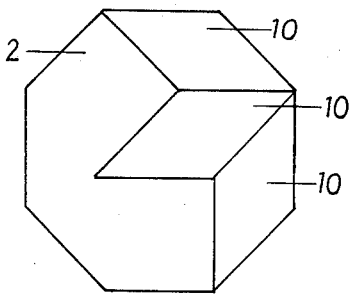
FIG. 20 shows a regular octagon dissected to form one irregular octagon and three rhombuses.
Figure 21:
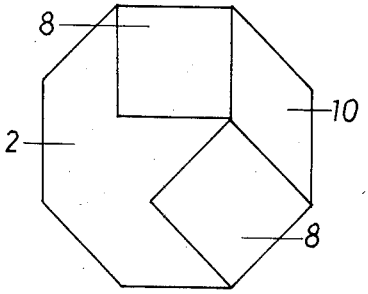
FIG. 21 shows a regular octagon dissected to form one irregular octagon, two squares, and one rhombus.

I have indicated the squares shown in FIGS. 8, 19, and 21 by the reference numeral 8.

I have indicated each rhombus by the reference numeral 10. It will be noted, by referring to FIGS. 1–8 inclusive, 10, and 13–21 inclusive, that each of the rhombuses is formed with two pairs of equilateral parallel sides.

Figure 22:
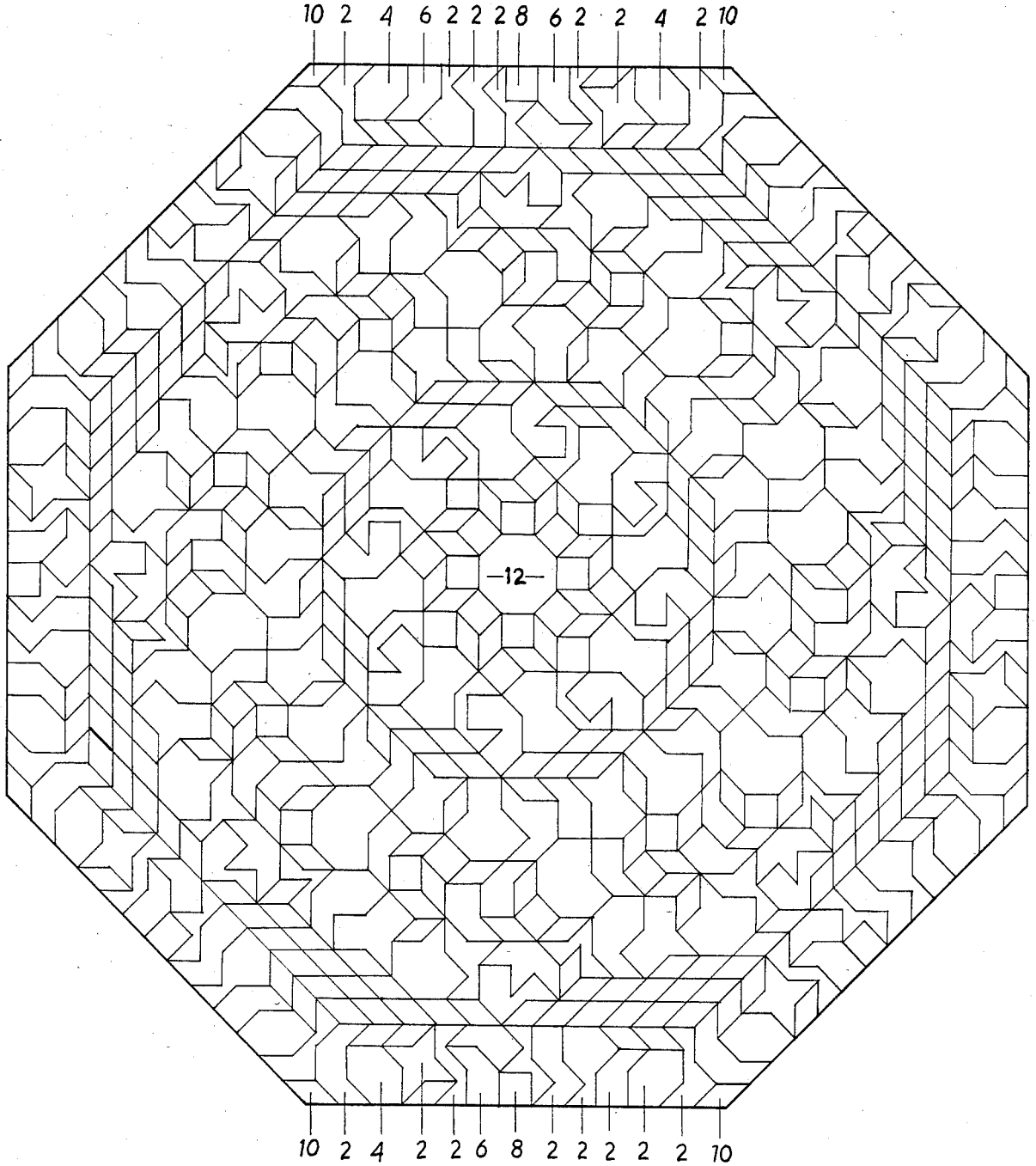
FIG. 22 shows one example of a tessellated octagon formed of eight sets of all of the pieces shown in FIGS. 1 through 21.
Figure 5:
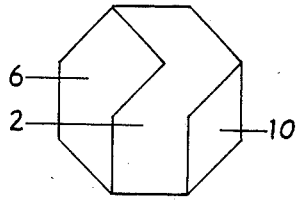
Figure 3:
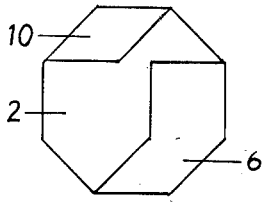

In all, there are seventy-six pieces formed by the dissection of twenty-one regular octagons. Eight sets of the seventy-six pieces produce six hundred eight pieces. These can be assembled to form a large tessellated octagon in hundreds of different ways, one example of which is shown in FIG. 22. This is the master puzzle.

Each of the assembled tessellated octagons has an octagonal opening in the center. This opening is indicated by the reference numeral 12.

Figure 5:
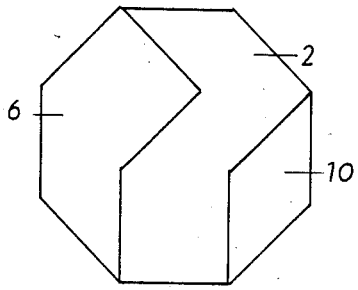
FIG. 5 shows a regular octagon dissected to form one irregular octagon, one irregular hexagon, and one rhombus.
Figure 6:
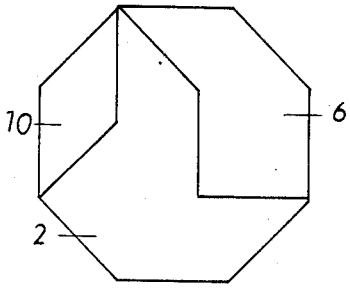
FIG. 6 shows a regular octagon dissected to form one irregular octagon, one irregular hexagon, and one rhombus.
Figure 7:
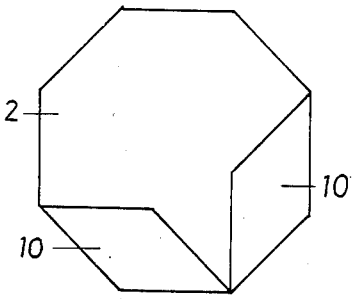
FIG. 7 shows a regular octagon dissected to form one irregular octagon and two rhombuses.
Figure 23:
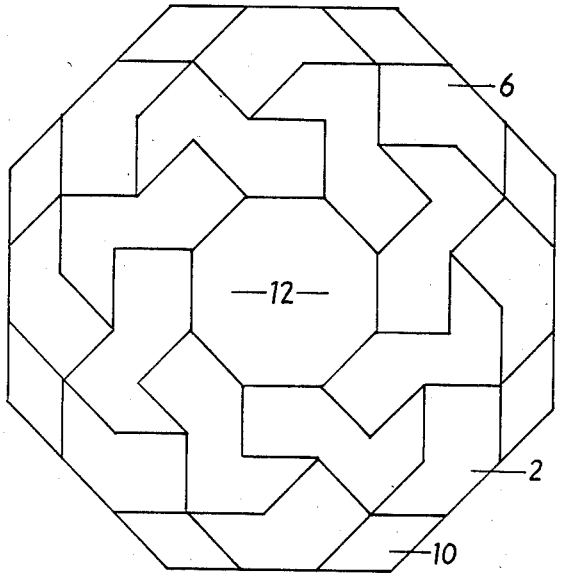
FIG. 23 shows a regular octagon assembled from eight sets of the pieces shown in FIG. 5.

Referring now to FIG. 23, I have shown a single tessellated octagon formed from eight sets of the pieces shown in FIG. 5, which has been reproduced above FIG. 23 for easy reference purposes.

Figure 3:
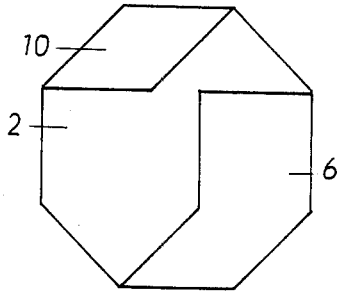
FIG. 3 shows a regular octagon dissected to form one irregular octagon, one rhombus, and one irregular hexagon.
Figure 24:
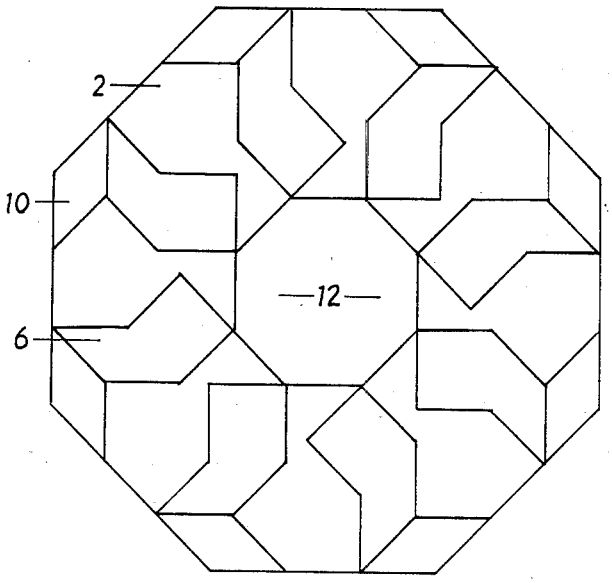
FIG. 24 shows a regular octagon assembled from eight sets of the pieces shown in FIG. 3.
Figure 10:
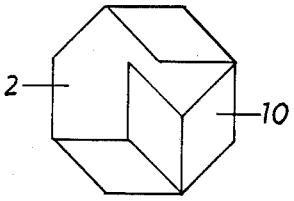
Figure 4:
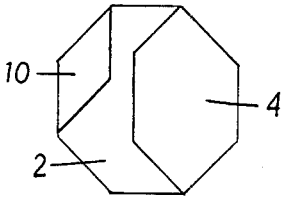

FIG. 24 shows a regular octagon formed from eight sets of the pieces shown in FIG. 3.

Figure 10:
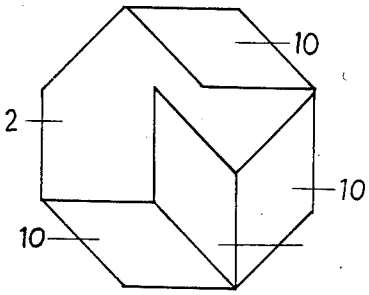
FIG. 10 shows a regular octagon dissected to form one irregular octagon and four rhombuses.
Figure 11:
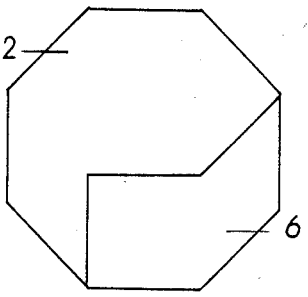
FIG. 11 shows a regular octagon dissected to form one irregular octagon and one irregular hexagon.
Figure 12:
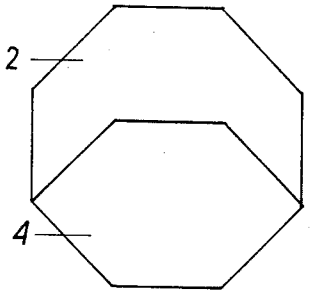
FIG. 12 shows a regular octagon dissected to form one irregular octagon and one regular hexagon.
Figure 13:
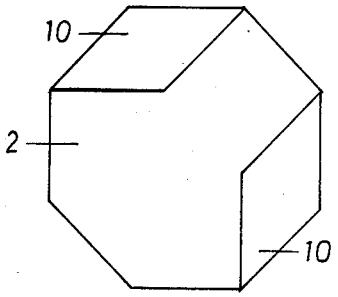
FIG. 13 shows a regular octagon dissected to form one irregular octagon and two rhombuses.
Figure 14:
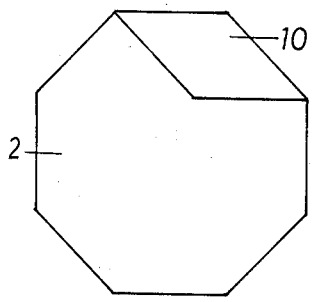
FIG. 14 shows a regular octagon dissected to form one irregular octagon and one rhombus.
Figure 15:
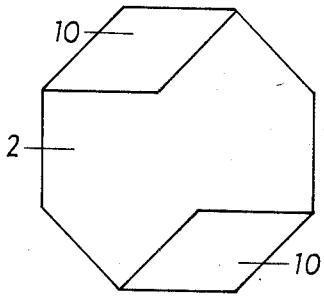
FIG. 15 shows a regular octagon dissected to form one irregular octagon and two rhombuses.
Figure 16:
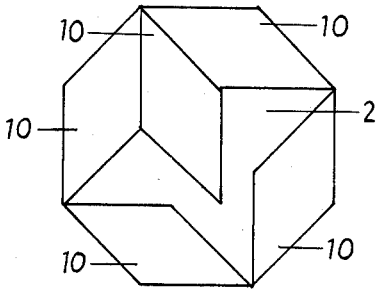
FIG. 16 shows a regular octagon dissected to form one irregular octagon and five rhombuses.
Figure 17:
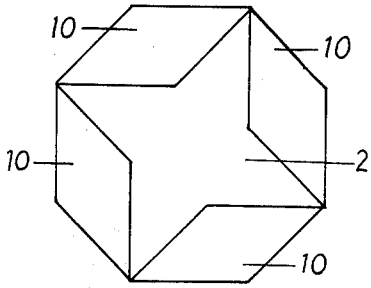
FIG. 17 shows a regular octagon dissected to form one irregular octagon and four rhombuses.
Figure 18:
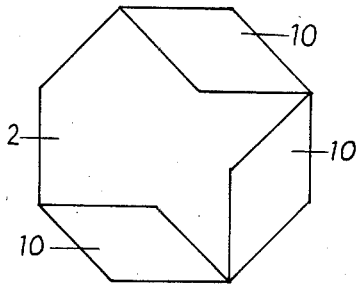
FIG. 18 shows a regular octagon dissected to form one irregular octagon and three rhombuses.
Figure 25:
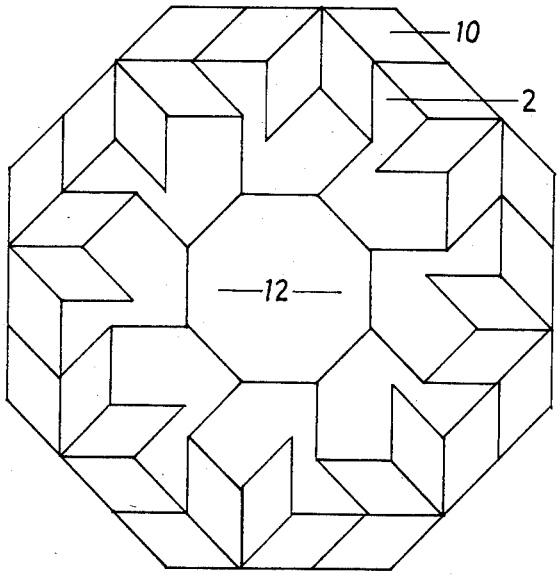
FIG. 25 shows a regular octagon assembled from eight sets of the pieces shown in FIG. 10.

Similarly, the regular octagon shown in FIG. 25 is formed from eight sets of the pieces shown in FIG. 10.

Figure 4:
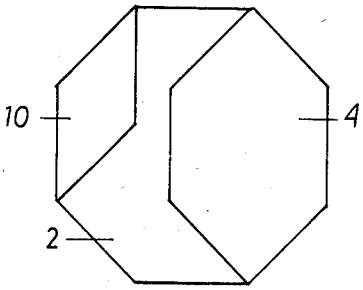
FIG. 4 shows a regular octagon dissected to form one irregular octagon, one rhombus, and one regular hexagon.
Figure 26:
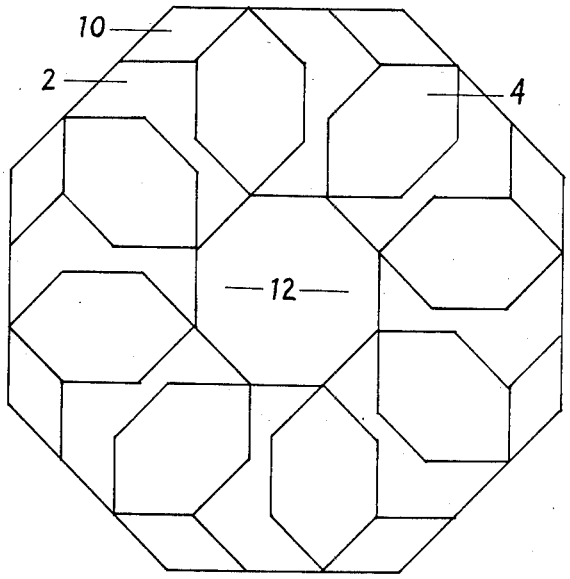
FIG. 26 shows a regular octagon assembled from eight sets of the pieces shown in FIG. 4.

FIG. 26 shows a regular octagon formed from eight sets of the pieces shown in FIG. 4.

Figure 27:
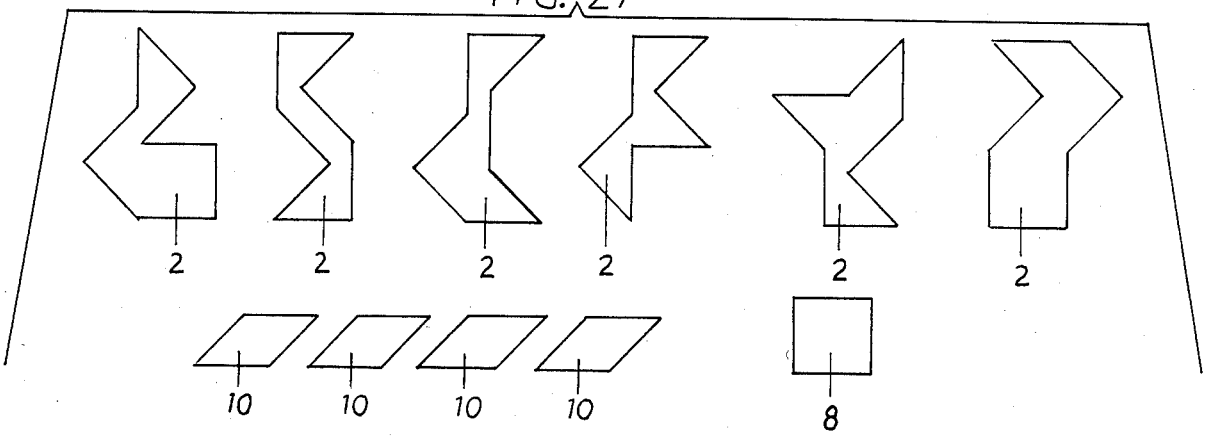
FIG. 27 shows one set of pieces comprising six irregular octagons, four rhombuses, and one square.
Figure 28:
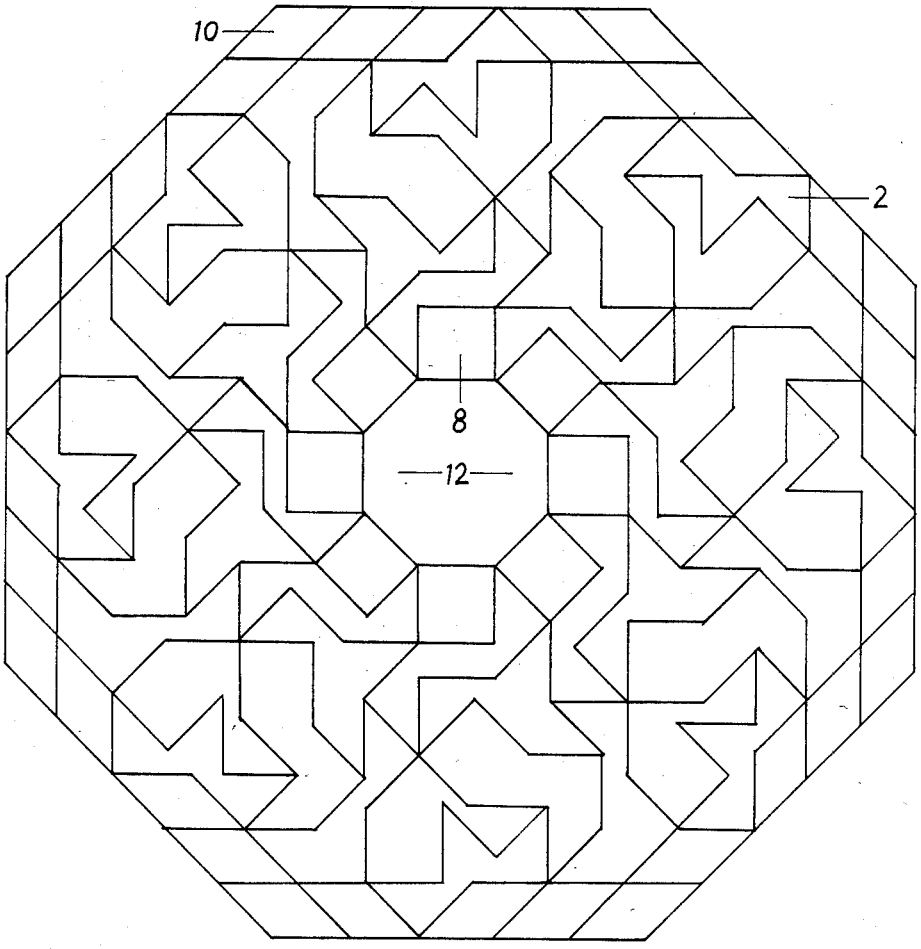
FIG. 28 shows a regular octagon formed of eight sets of the pieces shown in FIG. 27.

In FIG. 27, I have shown six irregular octagons, four rhombuses, and one square as a set. Eight sets of these can be assembled to form a larger regular octagon, one of which is shown in FIG. 28. I have made over fifty different regular octagons with the same group of eight sets of the pieces shown in FIG. 27. Furthermore, different permutations and combinations of pieces may be chosen to make other regular octagons, depending on the ingenuity of the user.

It is to be understood that, while I have shown only four examples of regular octagons made from eight sets of a single dissected octagon, twenty-one different octagons may be formed—namely, one from eight sets of the segments from each of the twenty-one octagons, the dissections of which are shown in FIGS. 1–21 inclusive.

The pieces of the puzzle may be constructed, as known to the art, from cardboard. I have constructed my puzzle by making blocks having the shape of identical regular octagons from ¼-inch foam-core board. I have subdivided the octagonal blocks, as shown in FIGS. 1–21, into segments. A number of segments form a group of parts. Depending on the manner in which the subdivision is performed, the segments, besides one irregular octagon, may number one, two, three, four, or five. A group can be formed of a number of like segments or of a number of different segments, as has been pointed out above. If desired, a felt-lined surface, on which the puzzle can be assembled, may be provided. Each of the irregular octagons may be colored in twenty-one different colors. The rhombuses, squares, regular hexagons, and irregular hexagons may be colored in black, white, and shades of gray. The coloring is optional. When the puzzle is assembled into an octagon, it will present a beautiful, artistic pattern, adding to the recreational and educational value of the puzzle. The geometric shapes arouse the curiosity inherent in their design.

It will be seen that I have accomplished the objects of my invention. I have provided an instructional and educational puzzle, formed of geometrically shaped pieces adapted to be assembled in various sets to produce a number of different tessellated octagons. I have provided a series of geometrically shaped pieces, including an irregular octagon, adapted to be assembled in various ways to produce a regular octagon. I have provided a plurality of pieces, obtained by dissecting a number of regular octagons in different manners, in which certain pieces may be colored, so that, when assembled, the pieces will form a regular octagon presenting an attractive and original tessellated design. I have provided a puzzle formed of geometrically shaped pieces which may be assembled in a large number of different ways, each assembly resulting in a tesselated regular octagon.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A puzzle comprising a plurality of pieces adapted to be juxtaposed to form a regular octagon, said pieces being formed by subdividing a number of blocks having the shape of a regular octagon to form a group of parts, which group includes a number of irregular octagons, said pieces comprising a number of said groups.

2. A puzzle as in claim 1 in which each part has the form of a multilateral geometric figure, the juxtaposed sides of which have the same length.

3. A puzzle as in claim 1 in which each irregular octagon is formed of four pairs of equilateral parallel sides.

4. A puzzle as in claim 1 in which said group of parts includes a plurality of rhombuses.

5. A puzzle as in claim 1 in which said group of parts includes a plurality of squares.

6. A puzzle as in claim 1 in which said group of parts includes a plurality of regular hexagons.

7. A puzzle as in claim 1 in which said group of parts includes a plurality of irregular hexagons, each irregular hexagon being formed of three pairs of equilateral parallel sides.

8. A puzzle as in claim 1 in which said group of parts includes 8 irregular octagons.

9. A puzzle as in claim 1 in which said group of parts includes 48 irregular octagons.

10. A puzzle as in claim 1 in which said group of parts includes 168 irregular octagons.

11. A puzzle as in claim 1 in which said group of parts includes 32 rhombuses.

12. A puzzle as in claim 1 in which said group of parts includes 8 squares.

13. A puzzle comprising 608 pieces adapted to be juxtaposed to form a regular octagon, said pieces formed by 8 groups of parts, each group being formed by subdividing each of 21 regular octagons in a different manner, and each group including 21 irregular equilateral octagons, 40 rhombuses, 6 squares, 7 irregular equilateral hexagons, and 2 equilateral regular hexagons, the juxtaposed sides of said pieces having the same length.

* * * * *